US007553271B2

(12) United States Patent
Wiesmann

(10) Patent No.: US 7,553,271 B2
(45) Date of Patent: Jun. 30, 2009

(54) TWO-PART ROTOR FOR A CENTRIFUGE WITH A CONNECTING AND UNLOCKING MECHANISM

(75) Inventor: Karl Grosse Wiesmann, Nottuln (DE)

(73) Assignee: Hengst GmbH & Co. KG, Muenster (DE)

( * ) Notice: Subject to any disclaimer, the term of this patent is extended or adjusted under 35 U.S.C. 154(b) by 0 days.

(21) Appl. No.: 12/066,420

(22) PCT Filed: Aug. 23, 2006

(86) PCT No.: PCT/EP2006/008256

§ 371 (c)(1),
(2), (4) Date: Mar. 11, 2008

(87) PCT Pub. No.: WO2007/031179

PCT Pub. Date: Mar. 22, 2007

(65) Prior Publication Data

US 2008/0207423 A1 Aug. 28, 2008

(30) Foreign Application Priority Data

Sep. 12, 2005 (DE) ..... 20 2005 014 427 U

(51) Int. Cl.
*B04B 7/02* (2006.01)
*B04B 9/06* (2006.01)

(52) U.S. Cl. ..... 494/49; 494/60; 494/64

(58) Field of Classification Search ..... 494/24, 494/36, 43, 49, 56, 64, 65, 67, 83, 84, 901, 494/60, 74, 79; 210/168, 171, 232, 360.1, 210/380.1, 416.5; 184/6.24
See application file for complete search history.

(56) References Cited

U.S. PATENT DOCUMENTS

| | | | | |
|---|---|---|---|---|
| 6,224,531 | B1 * | 5/2001 | Frehland et al. | 494/49 |
| 7,182,724 | B2 * | 2/2007 | South | 494/49 |
| 2002/0119882 | A1 | 8/2002 | Samways | |
| 2004/0157719 | A1 | 8/2004 | Amirkhanian et al. | |
| 2008/0207423 | A1 * | 8/2008 | Wiesmann | |

FOREIGN PATENT DOCUMENTS

DE 102004005920 8/2004

(Continued)

*Primary Examiner*—Charles E Cooley
(74) *Attorney, Agent, or Firm*—Greer, Burns & Crain, Ltd

(57) ABSTRACT

The invention relates to a rotor for a centrifuge for cleaning a liquid, in particular the lubricating oil of an internal combustion engine, wherein the rotor is designed in two parts, namely, on the one hand, a drive part and, on the other hand, a dirt-collecting part comprising a dirt collection area, wherein the dirt-collecting part can be connected to the drive part to the rotor, and wherein the dirt-collecting part can be detached, for disposal or cleaning, by being pulled off axially from the drive part. The rotor according to the invention is characterized in that the drive part and the dirt-collecting part are provided with an interacting connection arrangement which, when the dirt-collecting part is connected to the drive part, secures the dirt-collecting part against axial withdrawal relative to the drive part, and in that the dirt-collecting part is provided with an unlocking arrangement which interacts with the connection arrangement and which includes at least one gripping and actuating element that protrudes upward above the dirt-collecting part.

20 Claims, 7 Drawing Sheets

FOREIGN PATENT DOCUMENTS

| | | | |
|---|---|---|---|
| EP | DE202004008785 | | 10/2005 |
| WO | 2005/087383 | A1 * | 9/2005 |
| WO | WO2006/117141 | | 11/2006 |
| WO | 2007/031179 | A1 * | 3/2007 |

* cited by examiner

TWO-PART ROTOR FOR A CENTRIFUGE WITH A CONNECTING AND UNLOCKING MECHANISM

BACKGROUND OF THE INVENTION

The present invention relates to a rotor for a centrifuge for cleaning a liquid, in particular the lubricant oil of an internal combustion engine, the rotor having a two-part construction, having on the one hand a drive part and on the other hand a dirt-catching part that has a dirt collection area, the dirt-catching part being connectable to the drive part at the rotor, and the dirt-catching part being capable of being separated from the drive part by pulling it off axially, in order to dispose of it or clean it. Moreover, the present invention relates to a centrifuge having a rotor of the type named above.

Rotors of centrifuges are parts that must be exchanged or cleaned at certain intervals. At the time of the exchange or the cleaning, the rotors are wetted by the fluid cleaned in the centrifuge. In order to avoid frictional losses that would reduce their rotational speed, standard rotors have smooth outer surfaces, making manual grasping of the rotor in order to remove it from the centrifuge housing difficult. If the rotor is a part of a centrifuge for cleaning lubricant oil, a further difficulty is that the surface of the rotor is wetted by oil, which makes grasping it significantly more difficult than it already is due to the smooth outer surface. This problem exists both in one-part rotors, which are exchanged as a whole, and also in two-part rotors as mentioned above, which consist of a drive part that standardly remains in the centrifuge and a dirt-catching part detachably connected thereto, which is standardly an exchangeable part. In two-part rotors, it is important that during operation of the centrifuge the dirt-catching part be secured on the drive part both against undesired movements in the axial direction and also against relative movements in the circumferential direction. At the same time, however, it must remain possible to exchange the dirt-catching part as needed by pulling it off the drive part.

SUMMARY OF THE INVENTION

The object of the present invention is therefore to create a rotor of the type named above in which on the one hand it is ensured that the dirt-catching part is reliably secured in its position on the drive part during operation of the centrifuge, and that on the other hand the dirt-catching part is capable of being removed from the drive part quickly and easily for the purpose of maintenance of the centrifuge, in order to replace it with a new or cleaned dirt-catching part. In addition, a centrifuge that is particularly suitable for such a rotor is to be created.

The solution of the part of this problem relating to the rotor is achieved according to the present invention by a rotor of the type named above that is characterized in that on the drive part and on the dirt-catching part, cooperating, connecting means are provided that secure the dirt-catching part, in the state in which it is connected to the drive part, against being pulled off axially relative to the drive part, and that on the dirt-catching part unlocking means that cooperate with the connecting means are provided that comprise at least one grasping and actuating element that protrudes upward past the dirt-catching part.

In the rotor according to the present invention, it is advantageously ensured that the dirt-catching part is reliably secured in its position on the drive part, and in particular that it cannot by itself move undesirably far in the axial direction on the drive part. A certain degree of slight movement play can be useful here, in order for example to permit accommodation of varying thermal expansions. At the same time, in the rotor according to the present invention it is ensured that as needed, in particular during maintenance of the centrifuge, the dirt-catching part can easily be removed from the drive part; for this purpose, the grasping and actuating elements can be grasped by an operator either manually or using a simple tool. Advantageously, the unlocking of the connecting means and the pulling off of the dirt-catching part from the drive part take place together via the at least one grasping and actuating element; in this way, a particularly simple and ergonomic handling is achieved. Of course, the grasping and actuating element is formed in such a way that it can still be securely grasped and actuated even when it is wetted with a liquid, e.g. oil.

In another embodiment, it is preferably provided that the connecting means are constructed as locking connecting means that automatically enter into connecting engagement with one another when the dirt-catching part is connected to the drive part by axially plugging the dirt-catching part onto the drive part. In this way, it is ensured that when a fresh dirt-catching part is installed, a simple axial plugging onto the drive part is sufficient to bring the connecting means into connecting engagement. Installation errors that could result in an error in the effective connection in the axial direction between the drive part and the dirt-catching part are practically excluded in this way.

In addition, the present invention proposes that the connecting means comprise one or more snap hooks that, in the connected state of the drive part and the dirt-catching part, engage in one or more openings situated on the drive part. Such snap hooks are simple in the design and reliable in their functioning. The snap hooks can easily be configured such that they automatically enter into engagement in the direction of installation of the dirt-catching part, but block movement in the opposite direction of the dirt-catching part as long as the unlocking means are not actuated. The openings that cooperate with the snap hooks are also very easy to manufacture, which permits overall an economical manufacture of the rotor according to the present invention.

A development of the present invention provides that the connecting means at the side of the dirt-catching part are situated on two flexible arms that are situated opposite one another and that run essentially parallel to an axis of rotation of the rotor, and that the arms have, as unlocking means, arm ends that protrude upward past the rest of the dirt-catching part, these arms forming two grasping and actuating elements. Preferably, the arms are themselves flexible, or, if this is not the case, they are equipped with a spring element, the spring force holding the arms in their locking position if no external actuating forces are exerted on them. In this embodiment, the connecting means and the unlocking means are constructively combined, requiring a lower manufacturing expense and providing an additional contribution to lower manufacturing costs.

In a concrete development, the snap hooks on the arms point radially outward, and the arms can be pivoted radially inward towards one another for unlocking. In this embodiment, the unlocking is particularly simple, because here it is sufficient to use for example the thumb and index finger to press the two arms inward in the radial direction, against their own spring force or their spring element, and then, in this compressed state of the arms, to pull the dirt-catching part off the drive part using the two arms and the grasping and actuating elements formed by the ends of the arms.

In an alternative embodiment of the rotor, it is proposed that the connecting means at the dirt-catching part are situated on a ring that is flexible in the radial direction and is situated essentially in a radial plane concentric to an axis of rotation of the rotor, and that the ring protrudes upwards, past the rest of the dirt-catching part, as a whole or with two ring segments situated opposite one another as unlocking means. This ring forms, as do the arms mentioned above, a flexible and resilient element that permits the desired automatic engagement of the connecting means as well as the unlocking, which can be brought about by an unlocking action executed against the spring force exerted by the ring itself or by a spring element allocated to the ring.

In a concrete development, for this purpose it is provided that the snap hooks on the ring are situated opposite one another and point radially inward, and that for the unlocking the ring can be pressed inward radially at two areas situated between the snap hooks, simultaneously forcing the snap hooks to move radially outward. In this embodiment, the effect is exploited that a flexible ring having a constant circumference that is pressed inward radially at two opposite points will necessarily move outward in the radial direction at two additional points situated between these first two points in the circumferential direction, because the circumference of the ring does not change. The ring can initially have a round shape, and can then be deformed to an ellipse or an oval through the exertion of a radially inward-directed force at two force application points situated opposite one another. Alternatively, the ring may also already have an elliptical or oval initial shape which is then further deformed by the exerted force; depending on the construction of the ring, the deformation can go either in the direction of a "flatter" ellipse or oval shape or in the direction towards a circular shape.

For all above-described embodiments of the rotor, it is preferably provided that the dirt-catching part is an injection-molded part made of plastic, and that the connecting means at the dirt-catching part and the unlocking means are constructed in one piece with the rest of the dirt-catching part. In this way, the dirt-catching part becomes an economically manufacturable mass part that does not require any additional working steps for the attachment of the connecting means.

In addition to the above-described rotor, the present invention also relates to a centrifuge having such a rotor, the centrifuge comprising a housing that accommodates the rotor and that has a removable lid. According to the present invention, for the centrifuge it is provided that the lid has on its underside facing the rotor at least one blocking element that cooperates with the unlocking means and that, when the lid is in place, prevents the unlocking means from being displaced in the unlocking direction. In this way, it is ensured with a particularly high degree of security that an undesired self-displacement of the unlocking means in the unlocking direction cannot take place during operation of the centrifuge.

With regard to this, a development provides that the blocking element is a projection that extends in the axial direction into an area of movement of the unlocking means when the lid is put into place; when the lid is in place, this projection is situated radially inside or radially outside the unlocking means, and blocks a radially inward or radially outward unlocking movement of the unlocking means.

BRIEF DESCRIPTION OF THE DRAWINGS

In the following, two exemplary embodiments of the present invention are explained on the basis of a drawing.

DETAILED DESCRIPTION OF THE PREFERRED EMBODIMENTS

Figure 1:
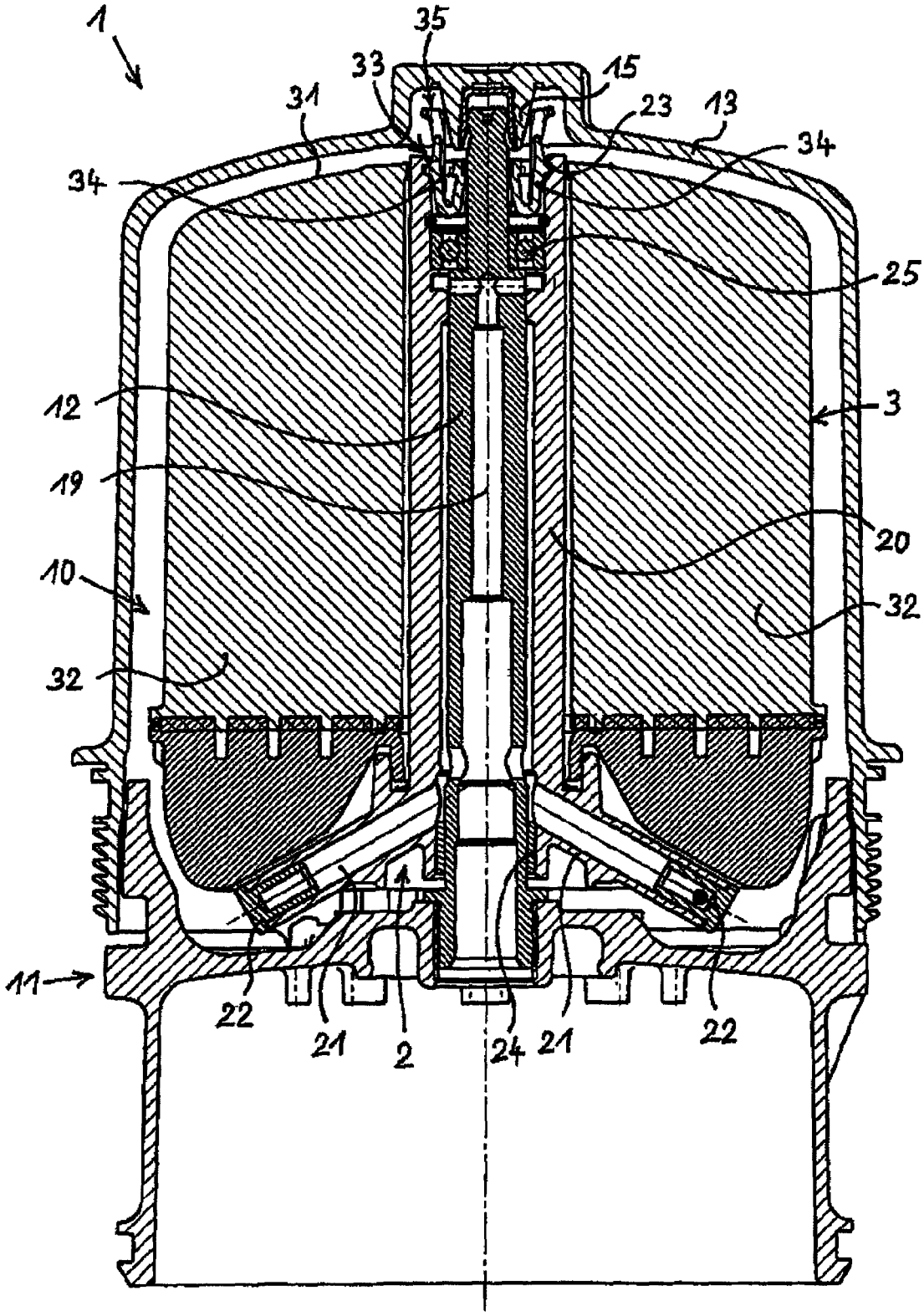
FIG. 1 shows a centrifuge having a rotor, in longitudinal section.

The exemplary embodiment shown in FIG. 1 of a centrifuge 1 comprises a rotor 10 that is rotatably mounted on an axle 12. Axle 12 is connected at its lower end to a part of a housing 11, hereby a screw connection. Upwardly, housing 11 is closed during operation of centrifuge 1 by a screw-on lid 13. Screw-on lid 13 stands in screwed engagement with another part of housing 11 that is not shown in FIG. 1 and that extends further downward from the lower area of lid 13 and surrounds the depicted part of housing 11.

Here, rotor 10 has a two-part construction, and comprises a drive part 2 and a dirt-catching part 3. Drive part 2 comprises a central hollow element 20 from whose lower end area two nozzle arms 21 extend outward and downward obliquely in the radial direction. At the free end of each nozzle arm 21 there is situated a respective jet nozzle 22 through which a liquid jet can be ejected in order to set drive part 2 into rotation via the reaction principle. For the rotatable mounting of drive part 2 on axle 12, a lower plain bearing 24 and an upper roller bearing 25 are used.

Dirt-catching part 3 is connected in rotationally fixed manner to drive part 2, so that dirt-catching part 3 also executes all rotational movement of drive part 2. Drive part 2 is usefully a permanent component that remains in centrifuge 1 over the entire lifetime of use of the centrifuge, while dirt-catching part 3 is an exchangeable part that can be pulled upward off drive part 2 in the axial direction for the purpose of maintenance, after removal of lid 13, and replaced by a fresh dirt-catching part 3.

In order to secure dirt-catching part 3 in the axial direction against undesired displacements relative to drive part 2, cooperating connecting means 23 and 33 are provided in the upper area of drive part 2 and dirt-catching part 3.

In the exemplary embodiment shown in FIG. 1, connecting means 23 at drive part 2 are made up of two recesses or openings on the radially inward-pointing side of the upper end of central hollow element 20 of drive part 2. In the assembled state of rotor 10 shown in FIG. 1, connecting means 33 at the dirt-catching part, in the form of two locking noses or locking hooks, engage in connecting means 23. The connecting means 33 formed by the locking noses or locking hooks are integrally formed on opposite-situated arms 34, on their radially outward-pointing side.

In section, as shown in FIG. 1, arms 34 are approximately U-shaped, and arms 34 are fashioned in materially unified fashion with the rest of the dirt-catching part, and are made of plastic. This gives arms 34 sufficient flexibility and spring force to perform their function. Connecting means 23 and 33, which engage with one another according to FIG. 1, ensure that dirt-catching part 3 cannot move in the axial direction, i.e. parallel to an axis of rotation 19 of rotor 10, relative to drive part 2.

The two arms 34 have unlocking means 35 that extend upward past a covering wall 31 of dirt-catching part 3. These unlocking means 35 are used to detach dirt-catching part 3 by disengaging connecting means 23 and 33, so that dirt-catching part 3 can be pulled off of drive part 2. For this purpose, lid 13 is removed, and unlocking means 35 are moved inwardly toward one another in the radial direction, e.g. by the thumb and index finger of an operator, causing connecting means 33 at dirt-catching part 3 to move inward in the radial direction far enough that they move out of engagement with connecting means 23 of drive part 2. In this position of connecting means 33, dirt-catching part 3 can then be pulled off of drive part 2 upward in the axial direction, and can be replaced by a new dirt-catching part 3. When installing new dirt-catching part 3, it is sufficient to push this part from the top downward onto drive part 2 in the axial direction, such that at the end of this plugging movement connecting means 23 and 33 automatically enter into locking engagement with one another.

In order to prevent undesired unlocking of connecting means 23 and 33 during operation of centrifuge 1, lid 13 has on its underside a blocking element 15. This blocking element has the form of a sleeve whose outer circumference is conical, and whose diameter becomes smaller from the top towards the bottom. When lid 13 is attached, this blocking element 15 moves downward in the axial direction into the area of movement of connecting means 33 and of unlocking means 35, and blocks these against movement inward in the radial direction, i.e. the detaching direction. Because dirt-catching part 3 forms together with drive part 2 the rotor 10 that rotates during operation of centrifuge 1, while lid 13 remains stationary, a sufficient movement gap must of course remain open between blocking element 15 on the one hand and connecting means 33 and unlocking means 35 on the other hand, so that disturbing friction does not occur.

In addition, in the exemplary embodiment of centrifuge 1 shown here, the upper end of axle 12 is supported and held in centering fashion in lid 13.

Finally, FIG. 1 also shows, in the interior of dirt-catching part 3, guide and dividing walls 32, situated precisely in the plane of the section, that run in the radial direction and that subdivide dirt-catching part 3 into a plurality of chambers situated next to one another in the circumferential direction.

Figure 2:
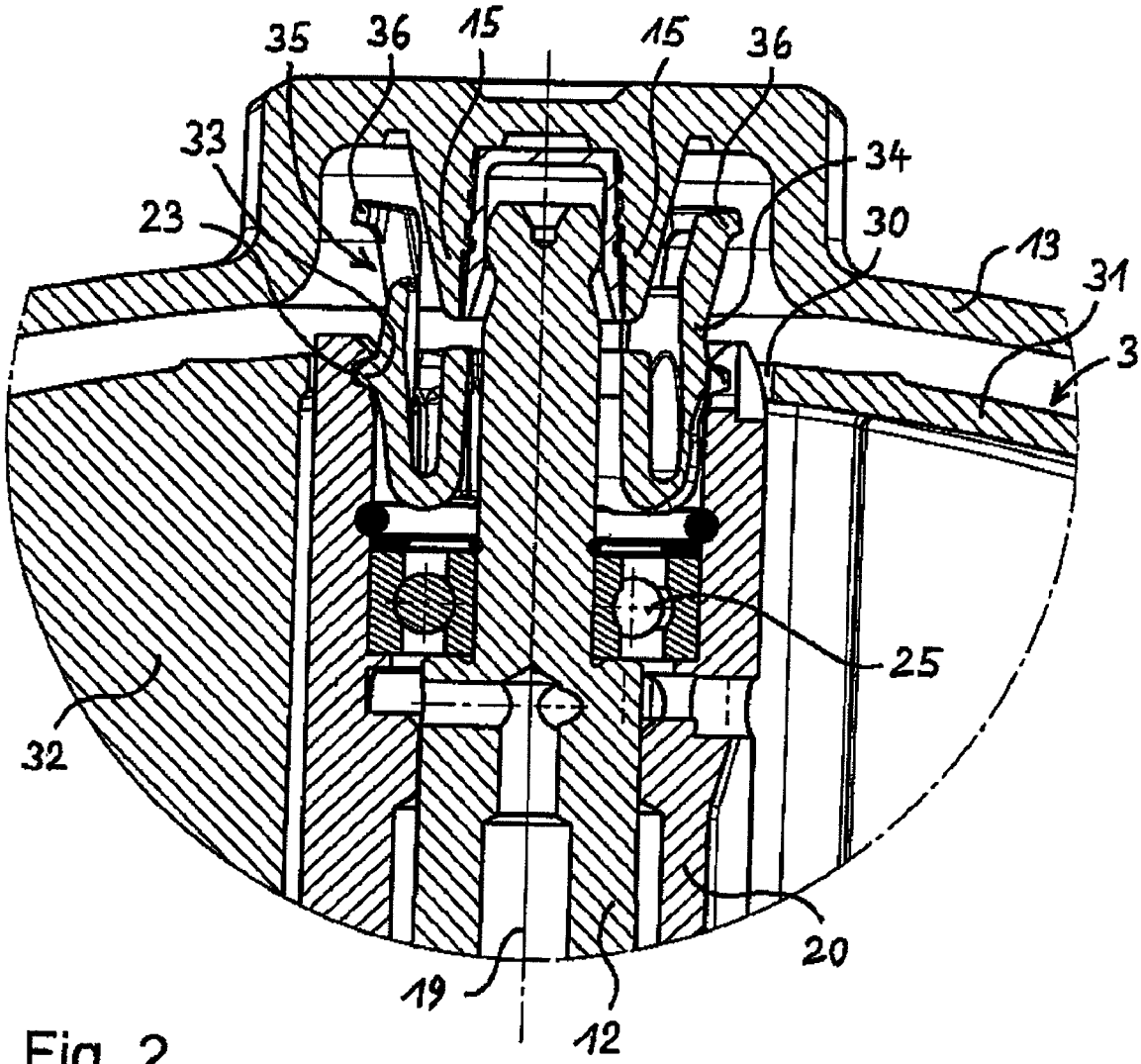
FIG. 2 shows a segment of the upper central area of the centrifuge in FIG. 1, also in longitudinal section, in an enlarged view.

FIG. 2 shows the area of centrifuge 1 having connecting means 23 and 33 in an enlarged detail view, also in longitudinal section; in the right half of FIG. 2, the position of the section is pivoted somewhat in the circumferential direction relative to FIG. 1. In the center of FIG. 2 there runs axle 12, on which the drive part, of which only an upper part of central hollow element 20 is visible here, is mounted. For this mounting, inter alia the roller bearing 25 visible in FIG. 2 is used that is situated between the outer circumference of axle 12 and the inner circumference of central hollow element 20.

In the left half of FIG. 2, one of the recesses that forms connecting means 23 is visible at the upper end of central hollow element 20, on the radially inward-pointing side of hollow element 20. In the right half of FIG. 2, the sectional plane runs differently than in FIG. 1, such that in the right half of FIG. 2 an area of central hollow element 20 is sectioned that is situated outside connecting means 23, seen in the circumferential direction.

In FIG. 2, the U shape of arms 34, connected radially inwardly and at the top to the rest of dirt-catching part 3, can be seen particularly clearly. From here, arms 34 run at first approximately downward in the axial direction, and then each bend radially outward and then upward in a U-shape. Close to the upper end of central hollow element 20, connecting means 33 at the dirt-catching part, in the form of radially outward-pointing locking noses or locking hooks, are situated opposite connecting means 23 of element 20. Arms 34 then continue upward as unlocking means 35, each terminating in a grasping and actuating element 36.

In the state of drive part 2 and dirt-catching part 3 shown in FIG. 2, their connecting means 23 and 33 are engaged with one another, thus preventing a movement of dirt-protecting part 3 in the axial direction relative to drive part 2.

Blocking element 15 on the underside of lid 13 prevents an undesired self-detachment of connecting means 23 and 33. In the assembled state of the lid, this blocking element 15 is situated in the movement area of arms 34, directed radially inward, thus blocking an unlocking movement. In order to avoid disturbing friction between unlocking means 35 and blocking element 15, a sufficiently large movement gap is left open between them.

It can also be seen in FIG. 2 that the upper end of axle 12 is supported and held in the center of lid 13 in centering fashion.

It can also be seen in FIG. 2 that dirt-catching part 3 has in its covering wall 31 two through-openings 30 in each of which there engages a part of the upper end area of central hollow element 20 of drive part 2, and through which unlocking means 35 protrude upward. In this way, it is possible simultaneously to provide a rotationally fixed connection between drive part 2 and dirt-catching part 3, and to prevent the relative movements of drive part 2 and dirt-catching part 3 in the circumferential direction during operation of the centrifuge.

If lid 13 is removed in order to perform maintenance, blocking element 15 is removed from the area of movement of unlocking means 35. Moreover, grasping and actuating element 36 of unlocking means 35 are then available for manual grasping by an operator. In this way, it is then very easy to actuate unlocking means 35 via grasping and actuating elements 36, for example using the thumb and index finger. For the unlocking, grasping and actuating elements 36 are pressed inward towards one another in the radial direction, causing connecting means 33 at the dirt-catching part, on arms 34, to move out of engagement with connecting means 23 on drive part 2. In this position, dirt-catching part 3 can then be pulled off of drive part 2 upward in the axial direction, held by grasping and actuating elements 36.

When placing a new dirt-catching part 3 onto drive part 2, connecting means 23 and 33 automatically move into locking engagement with one another, so that an actuation of unlocking means 35 is then not required.

Due to the position of the longitudinal section in the right half of FIG. 2, which is changed in FIG. 2 relative to FIG. 1, in the left half of FIG. 2 one of the guide and dividing walls 32 is again visible in section, while in the right half of FIG. 2 the view is now into one of the chambers inside dirt-catching part 3.

Figure 3:
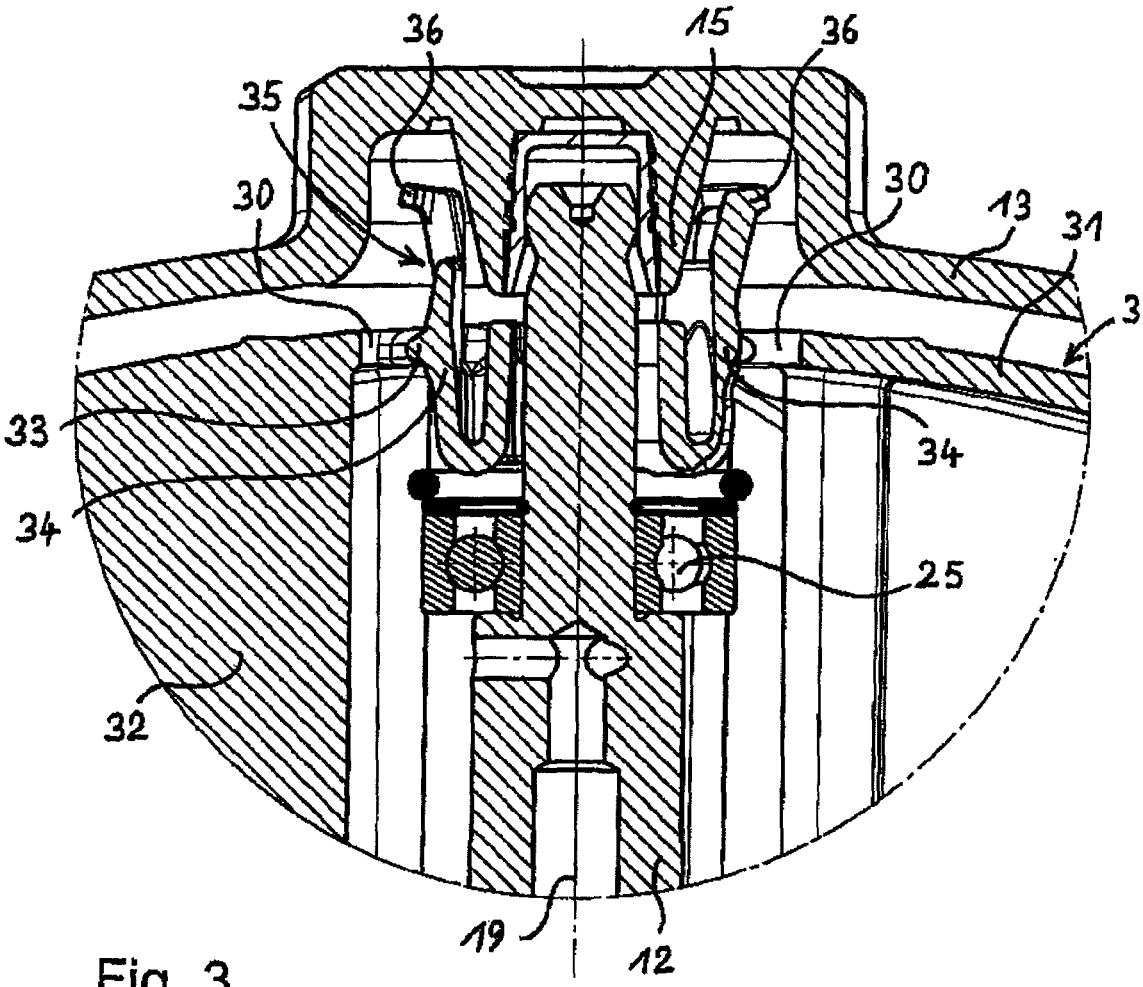
FIG. 3 shows the segment according to FIG. 2, in this case shown without a drive part of the rotor, also in longitudinal section.

FIG. 3 shows the same segment as does FIG. 2, but in FIG. 3, in order to illustrate the construction of dirt-catching part 3, drive part 2 (here its central hollow element 20) has been omitted.

In the center of FIG. 3, there is situated axle 12 on which upper roller bearing 25 is situated. Axle 12 is surrounded by dirt-catching part 3, of which one of guide and dividing walls 32 is again visible in section in the left half of FIG. 3, while in the right half of FIG. 3 the view is into one of the chambers inside dirt-catching part 3. Upwardly, dirt-catching part 3 is essentially sealed by covering wall 31, and through-openings 30 are situated in the central part of covering wall 31.

On covering wall 31 of dirt-catching part 3, arms 34 are integrally formed radially inwardly in one piece therewith; these arms are U-shaped and flexible. One of connecting means 33 at the dirt-catching part is integrally formed on each arm 34 in the form of radially outward-pointing locking noses or locking hooks. Further upward, arms 34 go over into unlocking means 35 with the respective grasping and actuating element 36. When lid 13 is in place, as is shown in FIG. 3, blocking element 15 on the underside of lid 13 prevents unlocking means 35 from moving radially inward, i.e. in the unlocking direction.

Figure 4:
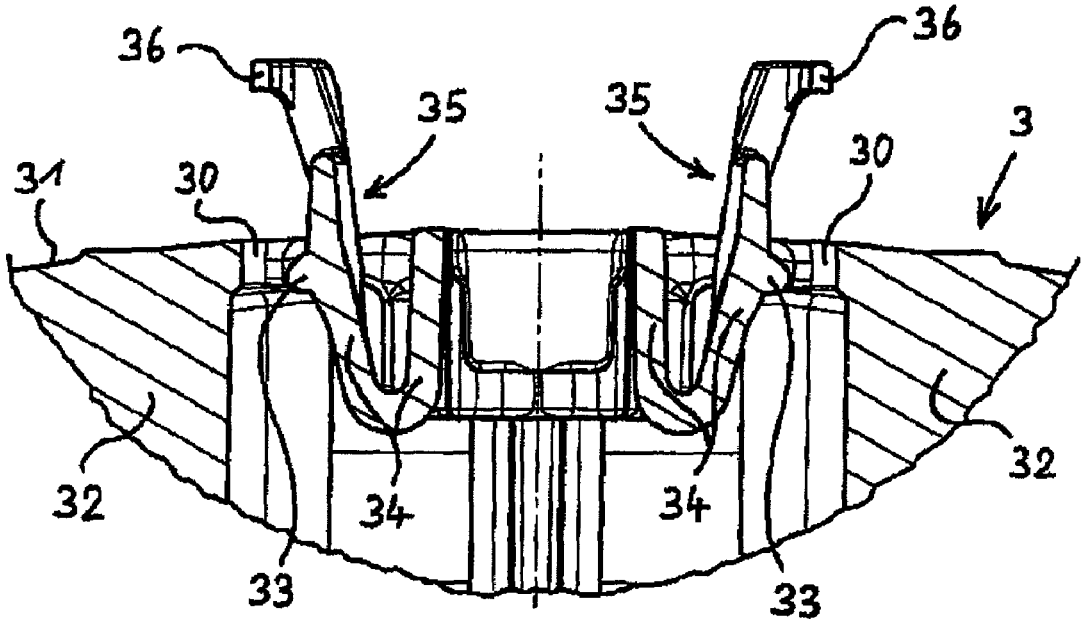
FIG. 4 shows a segment of the upper central area of a dirt-catching part that forms a part of the rotor, in longitudinal section.

FIG. 4 shows another segment, here a vertical section only through the upper central area of dirt-catching part 3. Here it can be seen particularly clearly that when the lid is removed, unlocking means 35 protrude upward with their grasping and actuating elements 36 far enough past covering wall 31 of dirt-catching part 3 to enable problem-free manual grasping and unlocking. This is easily possible even when the surfaces are oily, as in, for example, lubricant oil centrifuges.

Figure 5:
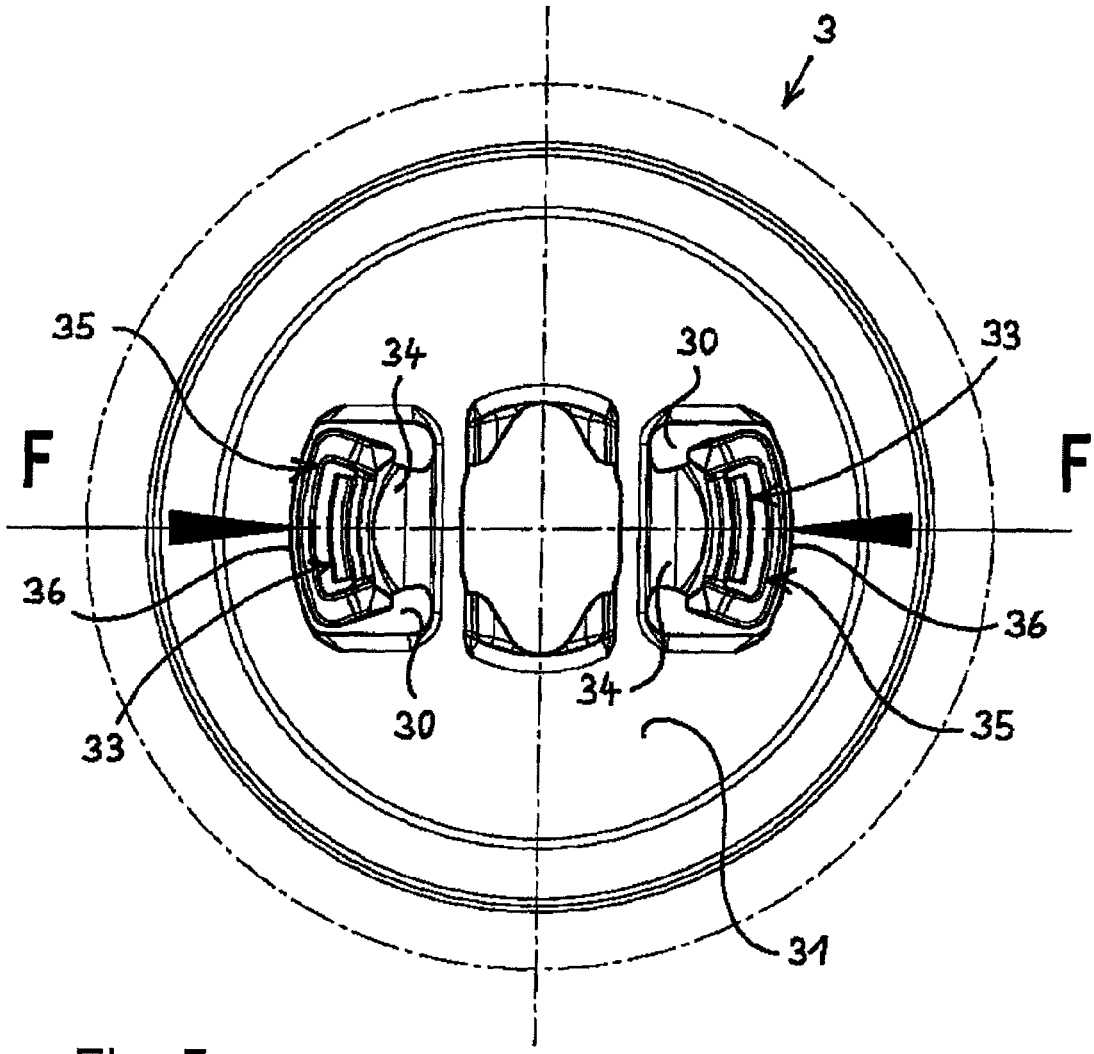
FIG. 5 shows the dirt-catching part of the rotor according to FIGS. 1 to 4, in a top view.

FIG. 5 shows dirt-catching part 3 from FIGS. 1 to 4 in a top view. Thus, here covering wall 31 of dirt-catching part 3 is visible, and through-openings 30 are situated in covering wall 31 to the left and to the right of the midpoint. Through through-openings 30, arms 34 protrude from the interior of dirt-catching part 3 upward, i.e. in the direction toward the viewer of FIG. 5. From each arm 34 one of connecting means 33 protrudes outward in the radial direction, in the form of the locking nose or locking hook. Radially externally thereto, in FIG. 5 unlocking means 35 are visible with their grasping and actuating elements 36. If a force is exerted on grasping and actuating elements 36 in the direction of arrows F according to FIG. 5, arms 34 move inward in the radial direction against their own spring force, causing connecting means 33 also to move inward in the radial direction, and in this way to move out of engagement with the connecting means on the drive part (which is not shown here). In this state, it is then possible to lift dirt-catching part 3 off the drive part by exerting a tensile force, oriented upward in the axial direction, on grasping and actuating elements 36.

Figure 6:
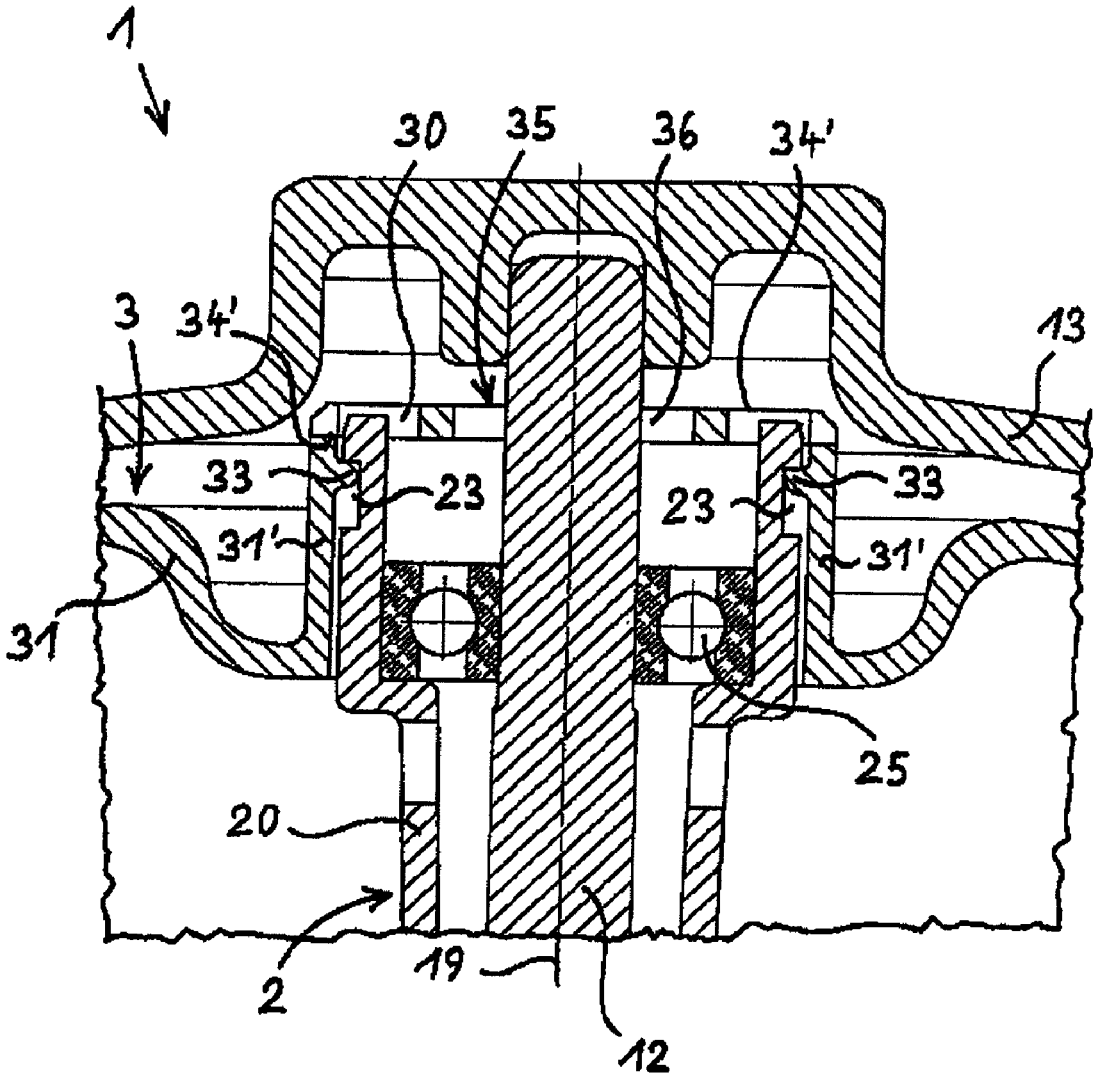
FIG. 6 shows a second exemplary embodiment, also in a longitudinal section through a central upper area of a centrifuge.
Figure 7:
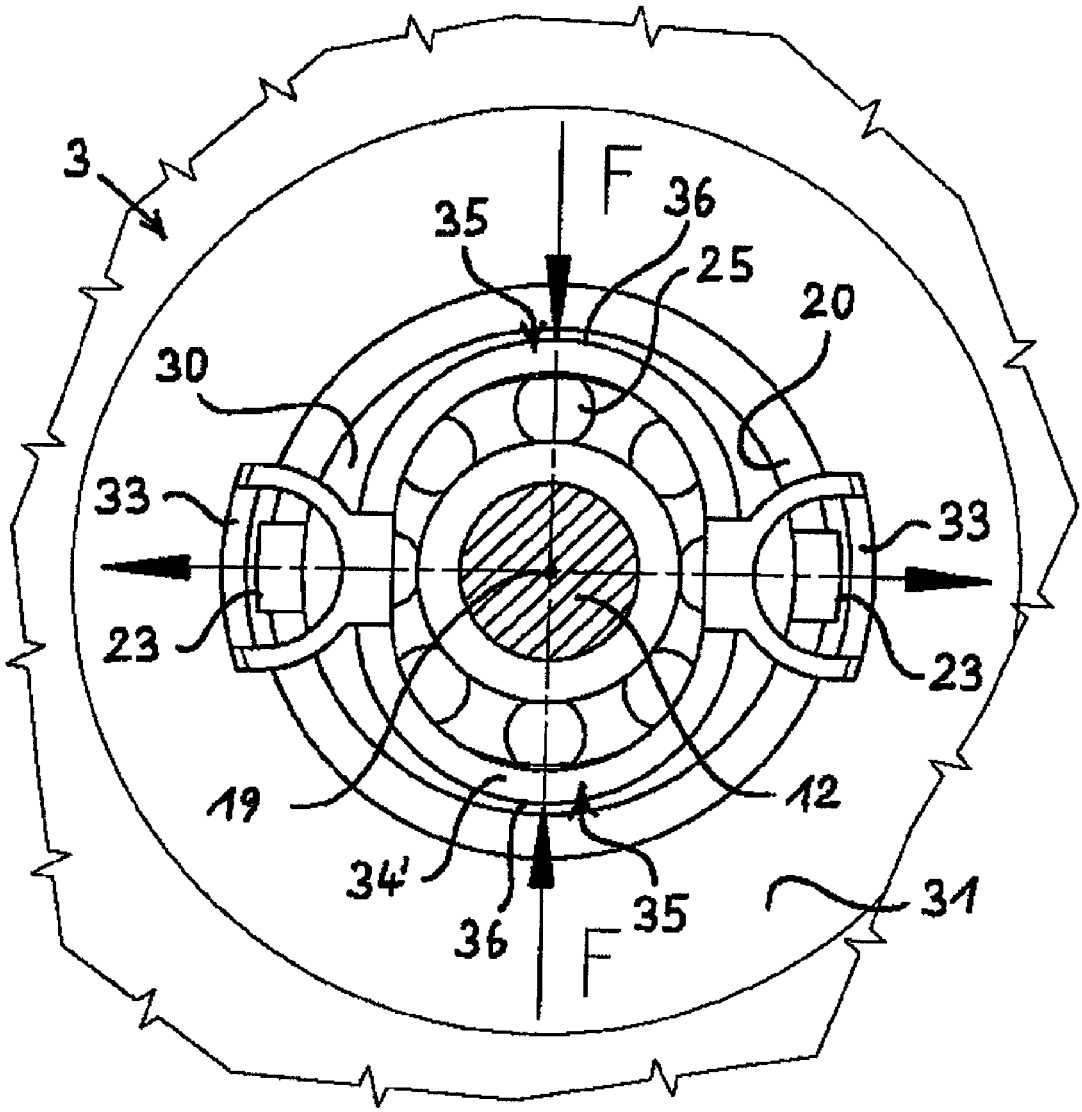
FIG. 7 shows a dirt-catching part of the rotor of the centrifuge from FIG. 6, in a top view.

FIGS. 6 and 7 show, in section and in a top view, a modified exemplary embodiment of centrifuge 1, in which connecting means 23 on drive part 2 and connecting means 33 on dirt-catching part 3 have a different construction.

In the section shown in FIG. 6, in the center axle 12 can be seen on which drive part 2, together with dirt-catching part 3, is rotatably mounted as a rotor about axis of rotation 19. Two bearings are used for the mounting, of which here upper bearing 25, in the form of a roller bearing, is visible. Bearing 25 is situated between the outer circumference of axle 12 and the inner circumference of a hollow element 20 that forms a part of drive part 2. Above bearing 25, central hollow element 20 runs further upward, and has there, at two areas situated opposite one another, grooves that open outwardly and that form connecting means 23 at the drive part.

Here as well, dirt-catching part 3 is upwardly limited by a covering wall 31 that has in its center a through-opening 30 through which the upper end of central hollow element 20 protrudes upward. In its central area, covering wall 31 has two wall segments 31' that run upward in the axial direction and are situated opposite one another and that run parallel to the upper end area of central hollow element 20 having connecting means 23 provided there. Wall segments 31' each bear one of connecting means 33, which here are present in the form of locking noses or locking hooks pointing inward in the radial direction, and which, in the assembled state of drive part 2 and dirt-catching part 3 shown in FIG. 6, engage with drive-part-side connecting means 23.

Upwardly, wall segments 31' go over into a ring 34' that runs approximately concentrically around axle 12, and that, like wall segments 31', is fashioned in a materially unified manner and in one piece with covering wall 31 and with the rest of dirt-catching part 3. Dirt-catching part 3 is made of plastic, which means that ring 34' and wall segments 31' are flexible and have resilient properties. In a basic state in which no external forces are exerted on ring 34', ring 34' and wall segments 31' have the shape and position shown in FIG. 6, in which connecting means 33 engage with connecting means 23. Thus, in this state dirt-catching part 3 is sufficiently secured against an axial displacement relative to drive part 2. A certain amount of movement play is allowed here in order to enable differing thermal expansions to be accommodated. Here, this is concretely achieved in that the grooves that form connecting means 23 are longer in the axial direction than the axial height of the locking noses and locking hooks that form connecting means 33.

Ring 34' that circumferentially connects wall segments 31' simultaneously acts as unlocking means 35 and as grasping and actuating element 36 in order to bring connecting means 33 and 23 out of engagement with one another and then to pull dirt-catching part 3 off of drive part 2 once lid 13 has been removed.

This function is illustrated in FIG. 7, which shows a top view of dirt-catching part 3 from FIG. 6. In the center of FIG. 7 there is situated axle 12, here sectioned in its upper end. Running centrally through axle 12 is axis of rotation 19 for dirt-catching part 3 and for the associated drive part (not shown here), which together form the rotor of the centrifuge.

Around axle 12 runs ring 34', which is shown here in a state in which a force is exerted on it in the direction of arrows F. At the points at which force arrows F make contact, the force causes a radially inward displacement of the force-charged areas of ring 34'. Because the ring is flexible and does not change its circumference, the exertion of force F necessarily results in a broadening of ring 34' outward in the radial direction, between the force contact points regarded in the circumferential direction; this broadening is shown by the two movement arrows drawn in at left and at right in FIG. 7. In this way, connecting means 33 situated there of dirt-catching part 3 move out of engagement with connecting means 23 of the drive part. In this unlocked state, dirt-catching part 3 on ring 34' can be lifted off upwardly from the drive part, i.e. perpendicular to the plane of the drawing, towards the viewer.

Radially externally from axle 12, upper roller bearing 25 is visible through central through-opening 30 in covering wall 31 of dirt-catching part 3. Through the radially external area of through-opening 30, the upper end of central hollow element 20 of the drive part is visible, on which drive-part-side connecting means 23 are provided.

Thus, in this embodiment ring 34' bears at its area pointing to the left and to the right in FIG. 7 the dirt-catching-part-side connecting means 33, while its areas situated at the top and at the bottom in FIG. 7 respectively form unlocking means 35 and grasping and actuating elements 36.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A rotor for a centrifuge for cleaning a liquid, in particular the lubricant oil of an internal combustion engine, the rotor having a two-part construction, having on the one hand a drive part and having on the other hand a dirt-catching part that has a dirt-collecting area, the dirt-catching part being connectable to the drive part at the rotor, and the dirt-catching part being capable of being separated from the drive part by being lifted off axially, in order to dispose of it or to clean it, comprising:

at the drive part and at the dirt-catching part, cooperating connecting means are provided that secure the dirt-catching part, in the state in which it is connected to the drive part, against being drawn off axially relative to the drive part, and on the dirt-catching part unlocking means are provided that cooperate with the connecting means and that comprise at least one grasping and actuating element that protrudes upward past the dirt-catching part.

2. The rotor as recited in claim 1, wherein the connecting means comprise locking connecting means that automatically enter into connecting engagement with one another when the dirt-catching part is connected to the drive part by axial plugging of the dirt-catching part onto the drive part.

3. The rotor as recited in claim 2, wherein the connecting means comprise one or more snap hooks that, in the connected state of the drive part and the dirt-catching part, engage in one or more openings situated on the drive part.

4. The rotor as recited in claim 3, wherein the snap hooks on the arms point radially outward, and wherein the arms are pivotable radially inward towards one another for unlocking.

5. The rotor as recited in claim 1, wherein the connecting means at the drive part are situated on two flexible arms that are situated opposite one another and that run essentially parallel to an axis of rotation of the rotor, and wherein the arms have, as unlocking means, arm ends that protrude upward past the rest of the dirt-catching part and that form two grasping and actuating elements.

6. The rotor as recited in claim 1, wherein the connecting means at the dirt-catching part are situated on a ring that is flexible in the radial direction and that is situated essentially in a radial plane, concentric to an axis of rotation of the rotor, and wherein the ring protrudes, as a whole or with two ring segments situated opposite one another as unlocking means, upward past the rest of the dirt-catching part.

7. The rotor as recited in claim 6, wherein the connecting means comprise one or more snap hooks arranged on the flexible ring that, in the connected state of the drive part and the dirt-catching part, engage in one or more openings situated on the drive part, the snap hooks on the ring being situated opposite one another and pointing radially inward, and wherein for unlocking the ring can be pressed radially inward at two areas situated between the snap hooks in the circumferential direction, simultaneously compelling the snap hooks to move radially outward.

8. The rotor as recited in claim 1, wherein the dirt-catching part is an injected-molded part made of plastic, and wherein the connecting means at the dirt-catching part and the unlocking means are fashioned in one piece with the rest of the dirt-catching part.

9. A centrifuge having a rotor as recited in claim 1, the centrifuge comprising a housing that accommodates the rotor and that has a removable lid, wherein the lid has on its underside facing the rotor at least one blocking element that cooperates with the unlocking means and wherein, when the lid is in place, blocks a displacement of the unlocking means in the unlocking direction.

10. The centrifuge as recited in claim 9, wherein the blocking element is a projection that, when the lid is put into place, enters in the axial direction into a movement area of the unlocking means, and wherein when the lid is in place is situated radially inside or radially outside the unlocking means, and blocks a radially inward-directed or radially outward-directed unlocking movement of the unlocking means.

11. A rotor for a centrifuge for cleaning a liquid, comprising:

the rotor, which is rotatable about an axis, having a two-part construction comprising a drive part and a dirt-catching part with a dirt-collecting area, the dirt-catching part being connectable to, but axially separable from, the drive part, a connecting mechanism located at the drive part and at the dirt-catching part to secure the dirt-catching part against being removed axially relative to the drive part, and an unlocking mechanism provided on the dirt-catching part that cooperates with the connecting mechanism comprising at least one grasping and actuating element that protrudes beyond the dirt-catching part.

12. The rotor as recited in claim 11, wherein the connecting mechanism is a locking connecting mechanism with parts that automatically enter into connecting engagement with one another when the dirt-catching part is connected to the drive part by axial plugging of the dirt-catching part onto the drive part.

13. The rotor as recited in claim 12, wherein the connecting mechanism comprises one or more snap hooks that, in the connected state of the drive part and the dirt-catching part, engage in one or more openings situated on the drive part.

14. The rotor as recited in claim 13, wherein the snap hooks on the arms point radially outward, and the arms are pivotable radially inward towards one another for unlocking.

15. The rotor as recited in claim 11, wherein the connecting mechanism at the drive part is situated on two flexible arms that are situated opposite one another and that extend essentially parallel to an axis of rotation of the rotor, and the arms have, as the unlocking mechanism, arm ends that protrude beyond the rest of the dirt-catching part and that form two grasping and actuating elements.

16. The rotor as recited in claim 11, wherein the connecting mechanism at the dirt-catching part is situated on a ring that is flexible in the radial direction and which is situated essentially in a radial plane, concentric to an axis of rotation of the rotor, the ring protruding, at least with two ring segments situated opposite one another as the unlocking mechanism, beyond a remainder of the dirt-catching part.

17. The rotor as recited in claim 16, wherein the connecting mechanism comprises at least two snap hooks arranged on the flexible ring that, in the connected state of the drive part and the dirt-catching part, engage in two or more openings situated on the drive part, the snap hooks on the ring being situated opposite one another and pointing radially inward, and wherein for unlocking, the ring can be pressed radially inward at two areas situated between the snap hooks in the circumferential direction, simultaneously compelling the snap hooks to move radially outward.

18. The rotor as recited in claim 11, wherein the dirt-catching part is an injected-molded part made of plastic, the connecting mechanism at the dirt-catching part and the unlocking mechanism being fabricated as one piece with a remainder of the dirt-catching part.

19. A centrifuge having a rotor as recited in claim 11 the centrifuge comprising a housing with a removable lid accommodating the rotor, wherein the lid has on its underside facing the rotor at least one blocking element that cooperates with the unlocking mechanism and, when the lid is in place, the blocking element blocks a displacement of the unlocking mechanism in the unlocking direction.

20. The centrifuge as recited in claim 19, wherein the blocking element is a projection that, when the lid is put into place, enters in the axial direction into a movement area of the unlocking mechanism, and that when the lid is in place is situated one of radially inside and radially outside the unlocking mechanism, and blocks one of a radially inward-directed and radially outward-directed unlocking movement of the unlocking mechanism.

* * * * *